US005274934A

United States Patent [19]

Newman, Jr.

[11] Patent Number: 5,274,934

[45] Date of Patent: Jan. 4, 1994

[54] INTERLOCKING FABRIC, BORDER CONSTRUCTIONS AND FRAMES

[76] Inventor: Eugene F. Newman, Jr., 7946 Stonehurst Dr., Dublin, Ohio 43017

[21] Appl. No.: 723,473

[22] Filed: Jun. 28, 1991

Related U.S. Application Data

[63] Continuation-in-part of Ser. No. 658,245, Feb. 20, 1991, abandoned.

[51] Int. Cl.[5] ..... D06C 3/08; B05C 17/06

[52] U.S. Cl. ..... 38/102.91; 38/102.1; 101/128.1

[58] Field of Search ..... 38/102.1, 102.91, 102.2, 38/102.4, 102.5, 102; 101/127.1, 128.1; 160/371, 378, 380

[56] References Cited

U.S. PATENT DOCUMENTS

| | | | |
|---|---|---|---|
| 977,210 | 11/1910 | Metcalfe | 38/102.91 |
| 2,903,967 | 9/1959 | Levin | 101/127.1 X |
| 3,078,793 | 2/1963 | Jaffa et al. | 101/127.1 |
| 3,255,540 | 6/1966 | Gilman | 38/102.91 |
| 3,541,957 | 11/1970 | Bubley | 101/127.1 |
| 4,023,488 | 5/1977 | Zimmer | 101/127.1 |
| 4,317,301 | 3/1982 | Timphony | 38/102 |
| 4,322,901 | 4/1982 | Spitzke | 38/102.91 X |

FOREIGN PATENT DOCUMENTS

| | | | |
|---|---|---|---|
| 909651 | 3/1945 | France | 38/102.1 |
| 1475147 | 4/1966 | France | 160/378 |
| 2194803 | 3/1988 | United Kingdom | 38/102.1 |

*Primary Examiner*—Clifford D. Crowder
*Assistant Examiner*—Bibhu Mohanty

[57] ABSTRACT

The invention relates to screen fabric, fabric border constructions, and screen frames. The fabric border constructions and frame are of a size and shape so as to releaseably fit and lock together. The fabric is attached to the border constructions and is of a size and shape in relation to the frame so as to be stretched to a precalculated tension upon being acted upon by the placement of the border strips on the frame. The invention provides for the border constructions and fabric to be released from the frame and later reattached duplicating the tension and placement of all coordinates of the fabric in relation to coordinates of the frame.

10 Claims, 10 Drawing Sheets

INTERLOCKING FABRIC, BORDER CONSTRUCTIONS AND FRAMES

CROSS REFERENCE TO RELATED APPLICATION

This application is a continuation-in-part of U.S. patent application Ser. No. 07/658,245 filed Feb. 20, 1991 titled Interlocking Fabric, Border Constructions and Frame now abandoned on Jun. 29, 1992.

BACKGROUND OF THE INVENTION

1. Field of the Invention

This invention relates in general to stretching fabric on frames and in particular to retensioning fabric on frames as used in screen printing.

2. Prior Art

Screen printing involves the use of stretched fabric that is attached to a frame. Desirable attributes of screens are 1) that the fabric is very tightly stretched to a consistent tension, 2) that the fabric is held in place on the frame, and 3) that the fabric after it is coated with emulsion and has had an art pattern exposed onto the emulsion can be released from the frame with the art pattern intact and put into storage to be later restretched on the frame so as to accurately duplicate the tension level previously attained and to accurately match the placement of the art pattern in relation to the coordinates of the frame with the position previously attained. It is also desirable that this process be achieved quickly and easily and that fabric is not wasted. The oldest method of stretching fabric is with clamps that are pulled by hand, pneumatic pressure, or mechanically. Tension meters are used to determine the tightness of the screen fabric and adjustments are made to either loosen or tighten the fabric in order to approach a prescribed tension level. Once the tension level is reached, the fabric is glued or stapled to the frame. Once this is done, the fabric cannot be released from the frame without destroying the fabric. These methods do not solve the problem of restretching the fabric or address efficient and convenient storage.

I have observed that in one field of screen printing, i.e., that of printing on glass cylinders, in which relatively loose fitting stainless steel fabric is used, the fabric has border strips of extruded plastic along one axis that cup over flanges on the outside of the frame thus holding the fabric in place on two sides only. The other two edges of the fabric have border strips of metal that are crimped on to the stainless steel fabric and bolted to the frame. This construction is specifically designed to allow electric current to flow through the screen and heat the screen to melt a thermoplastic printing ink. It was observed that there are no means in this construction to significantly tighten the fabric. The two edges of the fabric with the extruded plastic border strips can only be loosely pulled by hand and cupped over the frame flanges. The construction of the plastic borders does not provide a means for attaching a clamp or any type of stretching device to pull the fabric tight enough to meet the tension requirements of most screen printers. Also, there is no indexing of the extruded plastic border strips along the frame flanges which means that the plastic borders, which are shorter than the flange, could vary in their placement along the flanges. Along the other axis at the other two edges, the metal border strips were observed to be crimped onto the stainless steel fabric and had holes through which they were bolted to the frame. With more than just a minimal tension along this axis, the fabric would tear loose, especially polyester fabric.

This device allows the fabric to be loosely stretched, released, and loosely restretched with an art pattern only approximating its original position in relation to the coordinates of the frame.

Widely used today are draw bar frames U.S. Pat. Nos. 3,482,343 and 3,553,862 and roller frames U.S. Pat. Nos. 3,908,293 and 4,345,390. The draw bar frame incorporates pulling clamps as part of the frame and roller frames allow the fabric to be rolled tightly by means of rollers that form the four sides of a frame. These devices solved the problem of how to stretch fabric, release it for storage, and restretch the same fabric at a later time. However, it still required the trial and error method of reaching a prescribed tension level with the use of a tension meter and there still was no way of restretching an art pattern back to its original position in relation to the coordinates of the frame.

In U.S. Pat. No. 3,991,677 of 1976 by V. H. Barnes entitled "Printing Screen and Tensioning Means" is described a frame structure with a stretching mechanism incorporated into the frame structure. Also described is a screen with border strips that attach to tension bars of the stretching mechanism. In U.S. Pat. No. 3,211,089 of 1962 by Elmar Messerschmitt entitled "Screen Printing Screen" is described a frame structure with a stretching mechanism incorporated into the frame. The Messerschmitt invention uses a continuous border around the fabric which attaches to an element of the frame. The frame expands telescopically thereby stretching the fabric. U.S. Pat. No. 3,416,445 of 1965 by T. H. Krueger entitled "Screen Stencil with Separate Border Strips" describes various border strips, fabric, and frames. One embodiment of this invention has two adjacent sides of the fabric with border strips attached to a frame on studs whereas the other two opposite sides are pulled outward by flexible straps pinned to the border strips and wrapping around rotating crank shafts that are part of the frame. These flexible straps are all that hold these two border strips in place on this frame. Another embodiment of this invention features L shaped border strips. A third embodiment features a rigid continuous border that cannot be stretched and is fundamentally a frame attached to another frame.

The Barnes, Messerschmitt, and Krueger inventions require stretching mechanisms that are incorporated into the frames. The stretching mechanisms have moving parts which, like draw-bar frames and roller frames, are added expenses in the construction of the frames and add extra weight to the frames. These stretching mechanisms with their moving parts are exposed to the every day spraying, washing, and rinsing of the screens with water, cleaning compounds, solvents, and inks. They are subjected to the wear and tear of shop operations which usually includes a significant amount of mechanical shock. These parts, of course, depreciate under these severe conditions.

These three inventions do not utilize locking mechanisms that secure all four fabric edges into definite fixed positions on the frames. The Barne's invention does not have any pins, studs, abutments, etc. to fix the exact lateral location of the border strips on the tension bars. The Messerschmitt invention's continuous border is of a flexible material that stretches and is therefore unreliable as an aligning feature, particularly after repeated uses. The Krueger invention utilizes studs on two sides only to fix the locations of two unmoveable border strips. These two border strips do not at any time move to a more outward position on the frame. The other two border strips are attached to flexible straps which are unreliable as aligning features. Also, by only outwardly moving two border strips, the corner area between the stationary strips is under very little tension and the area between the two outwardly moved border strips is under extremely high tension. The tension throughout the fabric, because of the stretching method employed by this invention, is very inconsistent. This tension inconsistency in the fabric similarly exists in the L shaped border strips embodiment of this invention.

In none of the above cited references is there an inflexible aligning feature providing reliable alignment for a border strip that is moved to a more outward position. In none of the above cited references is there a discussion, object, or claim of controlling the stretch distances of the fabric along the X and Y axis by establishment of exact start and stop positions of the border strips so as to effect precalculated stretch distances for fabric of precalculated size and shape.

Whatever the precise merits, features, and advantages of the above cited references, none of them achieves or fulfills the purposes of the interlocking screen fabric, border strips and frames of the present invention.

SUMMARY OF THE INVENTION

A principal object of the present invention is to provide a quicker and easier means of attaching a screen fabric to rigid frames and roller frames so as to achieve a prescribed tension level in the fabric.

Another principal object of the invention is to provide a means of quickly and easily releasing the fabric from rigid frames and roller frames for convenient and economical storage after the fabric has been coated with emulsion and has had an art pattern exposed onto the screen and to provide a means of restretching the fabric and reattaching it to the frame so as to accurately duplicate the placement of the art pattern in relation to the coordinates of the frame with the placement of said art pattern previously attained.

In order to achieve a prescribed tension level in the fabric, the fabric and frame must be designed so that the fabric is of a prescribed size and shape in relation to the frame. The fabric has strips of rigid/semi-rigid material attached along the borders of all four fabric edges which are of a prescribed length, width, and position on the fabric border. The fabric edges extend laterally beyond the length of the strips so that the edges of the fabric are free and open in the fabric corner areas. For a rigid frame application, the strips are designed to easily attach to a variety of external stretching devices. For roller frames, the strips are designed to easily attach to the rollers. Each and every strip is designed to align and lock into a prescribed section of the frame.

The locking sequence with a rigid frame is to lock the first side of the fabric to the rigid frame in its prescribed place manually, attach the external stretcher device(s) to the strip on the opposite side, stretch the fabric until the border strip fastening features line up with the fastening features of the frame, and lock the side onto the frame. Next step is to attach the stretching device(s) to the fabric border strips along the other axis of the fabric, stretching both remaining sides and locking them onto the frame in a similar manner. Because the fabric has a precalculated stretch distance along the X and Y axis, the tension in the fabric will reach a prescribed level. The coordinates of the fabric will also become positioned in a consistent pattern.

The border strips can be held in place on the frame by means of an abutment flange on the border strip that slides over the outside edge of the rigid frame and snaps down into place over the rigid frame edge. The strips can then be more firmly secured in place with fasteners. There are a multiplicity of fastening devices which may be used within the scope of this invention.

With some fabric materials there is a predictable relaxing or loosening of the fabric within the first few hours after stretching. This is true, for example, with polyester fabrics. The polyester fabric will, however, stabilize at a prescribed tension if it is stretched in additional increments after it relaxes or loosens. To continue stretching, the stretching sequence is repeated with successively outward placements of all the border strips on the frame with the stretcher device.

In order to facilitate further stretching of the fabric, flange adaptors can be inserted between the border strip abutment flanges and the rigid frame as the border strips are pulled outward by the stretching device(s). The flange adaptors are held in place by the inward pull of the fabric which causes the border strips to pull inward against the flange adaptors pressing them against the sides of the rigid frame. The adaptors help to align a new set of fastening features on the border strips and frame. They also continue to provide additional support for the border strips in conjunction with the abutment flanges. Additional flange adaptors as well as additional fastener features on the border strips and frame permit successively greater stretching of the fabric.

Although this invention foresees an economic advantage in the use of just one set of external stretcher devices for an unlimited number of rigid frames with the rigid frames being more durable, lighter, less bulky, and less expensive than roller frames, this invention also includes utilization of roller frames to perform essentially the same function as rigid frames.

The steps used to stretch fabric with a roller frame are quite different than the steps used to stretch fabric with a rigid frame. The basic stretching action exerted on the fabric, however, is the same. Whereas a rigid frame depends upon external stretching devices, the rollers of a roller frame are themselves the stretching devices. In the fabric, border constructions and rigid frames of the present invention, the abutment flanges, flange adaptors, and fastener features provide precise stop positions for stretching the fabric. The fabric has a controlled stretch distance since the size and shape of the fabric are precisely controlled and provide an exact stretching start position. In order to have this same control in a roller frame it is necessary to control the stop positions of the rollers and to precisely control the size and shape of the fabric as well as the size, shape, and location of the border strips. All roller frames have features which permit the rollers to be rotated and locked in place. However, they lack a means of precisely controlling where the roller is locked in place. In order to achieve a precise stop position of the rollers, it is necessary to add a feature to the roller frames that does not exist in the prior art. This feature is a pin locator or indexing feature. By incorporating bores with support housings on the corner members of roller frames through which pins can be inserted into recesses on the roller end plugs, the rotational travel of the rollers can be precisely controlled. After aligning the roller so that the pin can be inserted through the end member bore into a roller recess, the roller is subsequently locked into position with whatever locking features the roller frame employs. The distance that the fabric is stretched is thereby controlled.

The fabric in a roller frame application is attached to border strips in the same manner as with rigid frames. However, the border strips need not have attachment flanges to attach to external stretcher devices or abutment flanges to add strength to the border strips and facilitate alignment. These are unnecessary with roller frames of the present invention. The border strips are merely designed so as to insert within a channel of the roller so as to align fastening features of the border strip and roller. These fastening features may cooperate with pins, screws, studs, etc. that securely fasten the border strip and roller together in a precise location. The border strip may comprise a cupped shape which hooks over a flange in the roller channel with alignment being accomplished through the abutment caused by the length of the strip being the same as the length of the channel. As with a rigid frame of the present invention, it is necessary that the border strips, fabric, and roller frame be of prescribed sizes and shapes and that the border strips be at prescribed locations on the fabric so that there is a controlled stretch distance of the fabric along both the X and Y axis.

The locking sequence with a roller frame is to align all four rollers in a start position by rotating the rollers to a position such that locator pins are inserted into designated recesses in the rollers and the rollers are locked in place by the locking features of the roller frame. Next step is to insert all four border strips into the roller channels. If the border strips have fasteners such as screws, these are fastened in place at this time. Next step is to take the locator pin out of one roller and rotate the roller so that the locator pin can be reinserted at a designated advanced recess on the roller. The roller is then locked in place by the locking features of the roller frame. The roller recess locations are precalculated so as to achieve a prescribed stretch distance in the fabric. By rotating each roller in this manner, the fabric is stretched a prescribed distance in both the X and Y axis. This will achieve a prescribed tension in the fabric. Because some fabrics will relax or loosen in predictable amounts within the first few hours of stretching, it may be necessary to continue stretching the fabric by rotating the rollers so as to align the pins to even more advanced recess locations. These more advanced recesses are located so as to produce precalculated additional stretch distances of the fabric. In this manner the tension of the fabric can be stabilized at a prescribed level.

For both rigid frame and roller frame applications the fabric can be released easily and quickly by reversing the attachment process. Because the fabric and border strips are much thinner than the frame and represent a much less overall cost to the screen printer than the combined fabric and frame, the printer can inexpensively store fabric with art using very little space. Storing and reusing screens according to the present invention spares the printer the time and cost of coating and exposing the same art pattern again at a later time.

DETAILED DESCRIPTION

Figure 1:
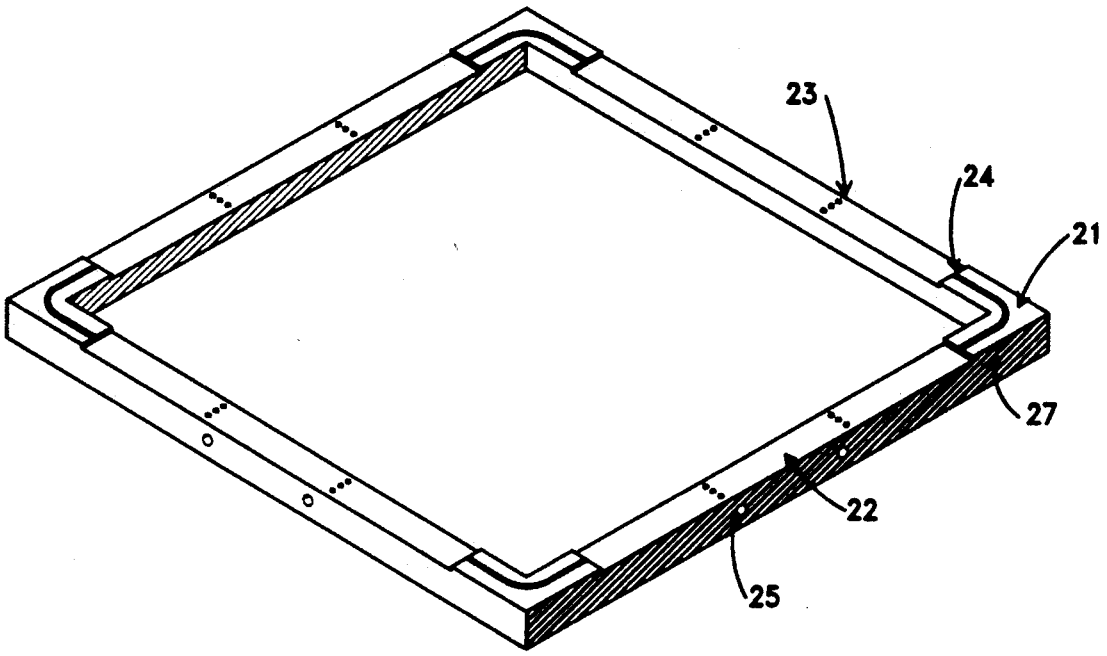
FIG. 1 is a perspective drawing of one embodiment of the rigid frame of the present invention as seen from the bottom or print side.
Figure 2:
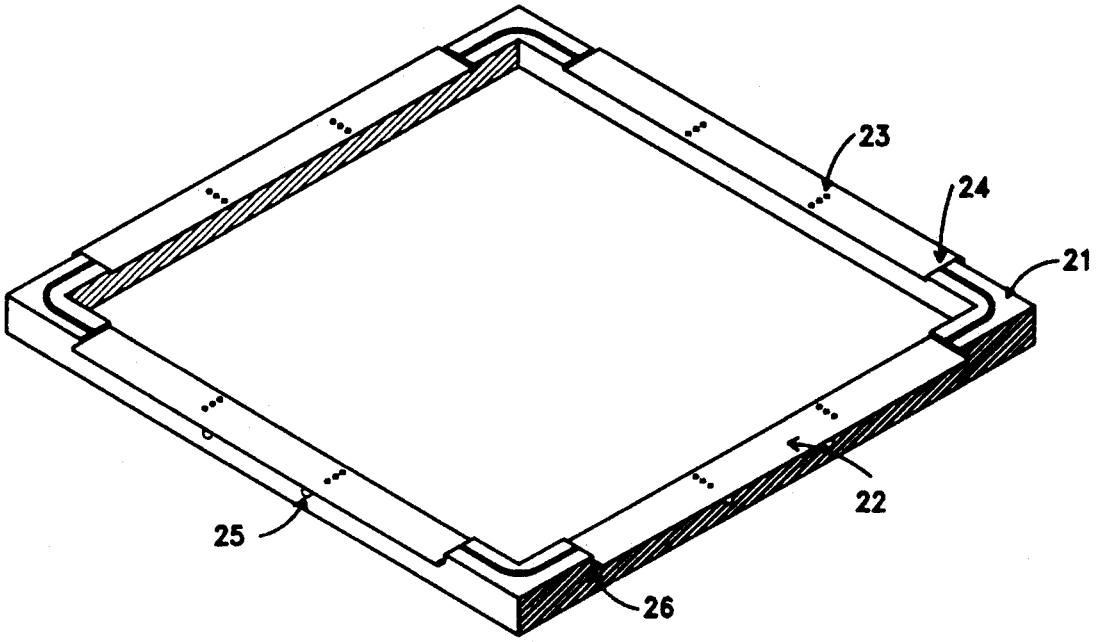
FIG. 2 is a perspective drawing of a second embodiment of the rigid frame of the present invention as seen from the bottom or print side.
Figure 3:
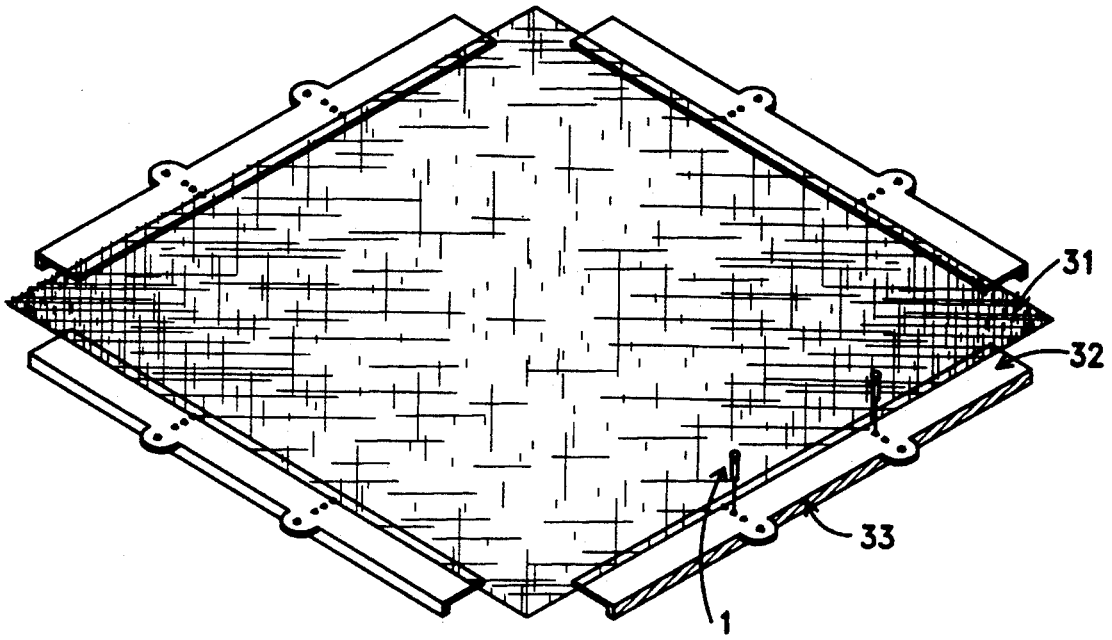
FIG. 3 is a perspective drawing of the fabric and rigid/semi-rigid border strips of the present invention as seen from the bottom or print side.

The interlocking fabric, border constructions and frames of the present invention includes a rigid frame as in FIGS. 1 and 2 and it includes fabric with rigid/semi-rigid border strips as in FIG. 3.

Referring to FIGS. 1 and 2, the rigid frame can be made of any solid material such as stainless steel, aluminum, wood, plastic, etc. The top surface, 21, in and adjacent to the corners are elevated above the surfaces, 22, between the corners. Fastening features, 23, are constructed into the surface areas, 22, at predetermined locations. These allow for precisely measured successively outward placement of the border strips. Channels, 24, are hollowed out of the surface areas, 21, and run along the corners as seen in the drawing. Insertion recesses, 25, are at precalculated locations on the rigid frame outside wall, 27, so as to align and secure stretcher devices to the rigid frame.

FIG. 2 shows flanges, 26, that extend outward beyond the outside wall, 27, of the rigid frame.

FIG. 3 shows the fabric, 31, that is of a precalculated size and shape in relation to the size and shape of the rigid frame. The fabric is glued, molded inserted, etc. onto the outward facing surface, 33, of the border strips, 32. The border strips are constructed out of a solid material such as plastic, stainless steel, aluminum, wood, etc. and must be strong enough and rigid enough to provide a sufficient medium for pulling the fabric and holding it in place while under tension. The border strips are attached to the fabric in precise precalculated locations in relation to the coordinates of the fabric and the rigid frame or roller frame so as to produce a precise and precalculated tension in the fabric when the border strips are pulled to their precalculated stop positions on the rigid frame. The strips are of an exact length to align themselves with the lower surface level, 22, of the rigid frame of FIGS. 1 and 2 and slide in between the higher corner sections, 21, of FIGS. 1 and 2. The thickness of the border strips is designed to exactly match the difference in height between the lower and upper surface levels of the rigid frame. The fabric, which is on the outward facing surface of the strips aligns with the elevated surface of the corner sections when the border strips are pulled into position along surface areas, 22, of FIGS. 1 and 2.

Figure 4:
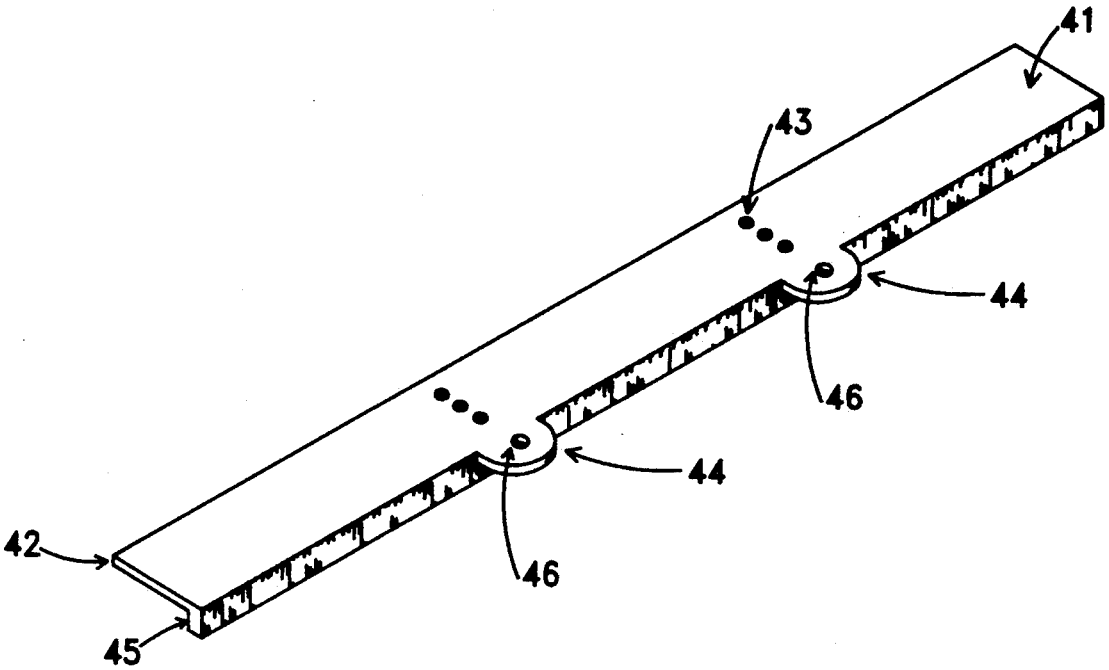
FIG. 4 is a perspective drawing of one embodiment of the rigid/semi-rigid border strip of the present invention.
Figure 6:
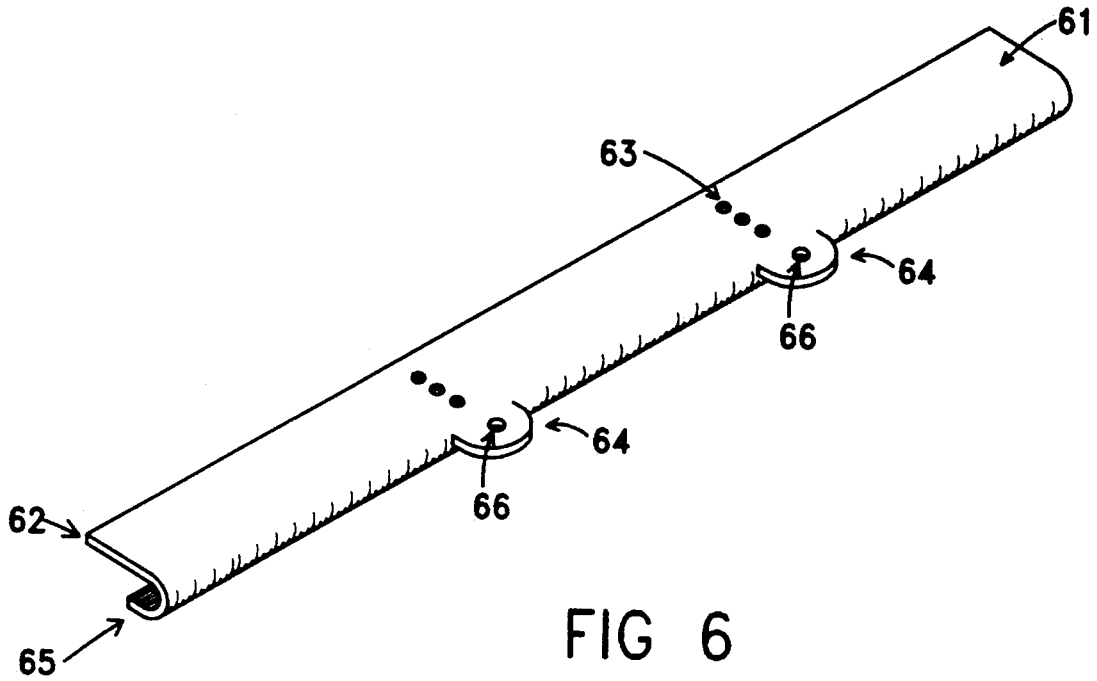
FIG. 6 is a perspective drawing of a second embodiment of the rigid/semi-rigid border strip of the present invention.

Referring to FIGS. 4 and 6, drawings of the preferred embodiments of the border strips for rigid frames are shown. The outward facing surface, 41, of FIG. 4 and, 61, of FIG. 6 is flat. This surface is glued to or molded to the fabric. The thickness, 42, of FIG. 4 and, 62, of FIG. 6 of the strips is such as to provide for a flat surface along the entire frame bottom once the strips are pulled into position between the corners of the rigid frame. Likewise, the length of the strips is such as to provide for an exact fit between the corner sections. With predetermined locations so as to align with fastening features, fastener holes, 43, of FIG. 4 and, 63, of FIG. 6 are manufactured into the border strips. These holes are in predetermined locations to control precisely measured outward placements of the border strips. These holes may be reinforced with metal eyelets. Once the border strips are pulled into place, they may be fastened onto the rigid frame at these points with pins, screws, bolts, or any such fastening devices (1).

Attachment flanges, 44, of FIG. 4 and, 64, of FIG. 6 extend beyond the leading edge of the border strips to permit hooking or clamping by stretcher devices. The attachment flanges may have holes, 46, of FIG. 4 and, 66, of FIG. 6 which may be reinforced with metal eyelets. FIG. 4 shows an abutment flange, 45, at a right angle that is ideal for the rigid frame as shown in FIG. 1. The abutment flange slides across surface, 22, in FIG. 1 and snaps over the edge of the rigid frame. It facilitates the exact alignment of the border strip because the inward pull of the fabric presses the abutment flange firmly against the rigid frame outside wall, 27, once the stretcher device is released. It also provides added strength to the border strip and compensates for any flexibility in the border strip material.

Figure 5:
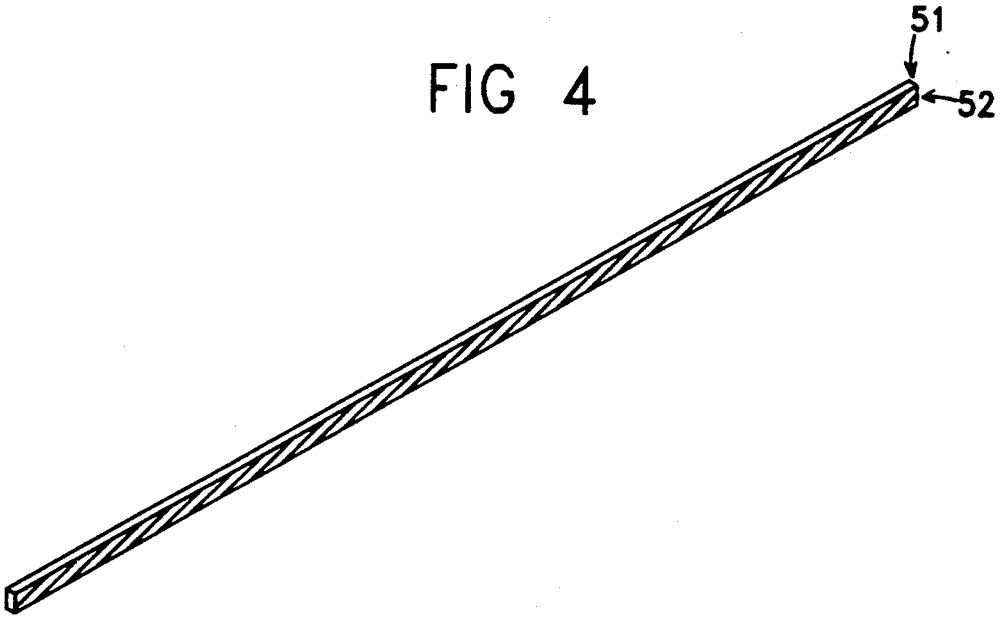
FIG. 5 is a perspective drawing of one embodiment of the flange adaptor of the present invention.

FIG. 5 shows a flange adaptor that can be used with the border strip of FIG. 4. Said adaptor is inserted between the abutment flange, 45, of FIG. 4 and the frame outside wall, 27, of FIG. 1 when the border strip is pulled to a more outward position. The frame adaptor is held in place between the border strip and the abutment flange by the inward pull of the fabric once the stretcher device is released. The flange adaptor serves the useful purpose of facilitating the alignment of the new fastening features associated with the more outward location of the border strip. The flange adaptor is of a precalculated width, 51, to provide a precalculated new stop position for the border strip and provide a precalculated new stretch distance of the fabric. It also helps the abutment flange to continue adding strength to the border strip.

FIG. 6 shows a border strip design with a cupped shape, 65, on one edge. This border strip is designed to hook over the flange, 26, of FIG. 2 of the rigid frame. The cupped edge serves essentially the same purpose as the abutment flange, 45, of FIG. 4. In all other respects the border strip of FIG. 6 is the same as the border strip of FIG. 4.

Figure 7:
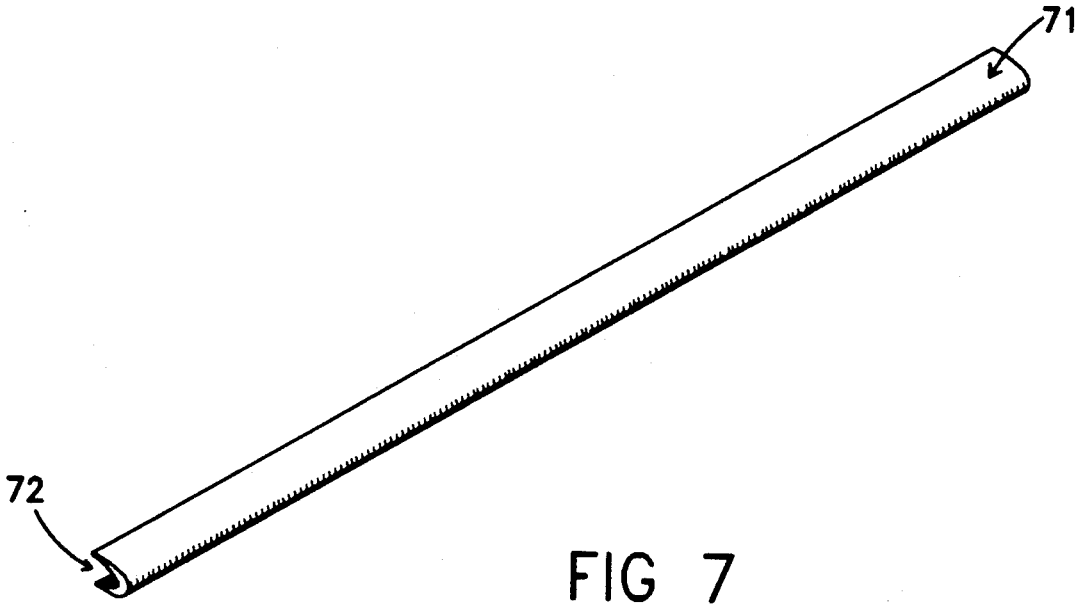
FIG. 7 is a perspective drawing of a second embodiment of the flange adaptor of the present invention.

FIG. 7 shows a flange adaptor that can be used with the border strip of FIG. 6. It performs the same functions as the flange adaptor of FIG. 5 and is so shaped so as to easily fit within the cupped shape, 65, of the border strip of FIG. 6. The shape of this adaptor is designed to provide a new cupped shape, 72, to cup over the flange, 26, of FIG. 2.

Figure 10:
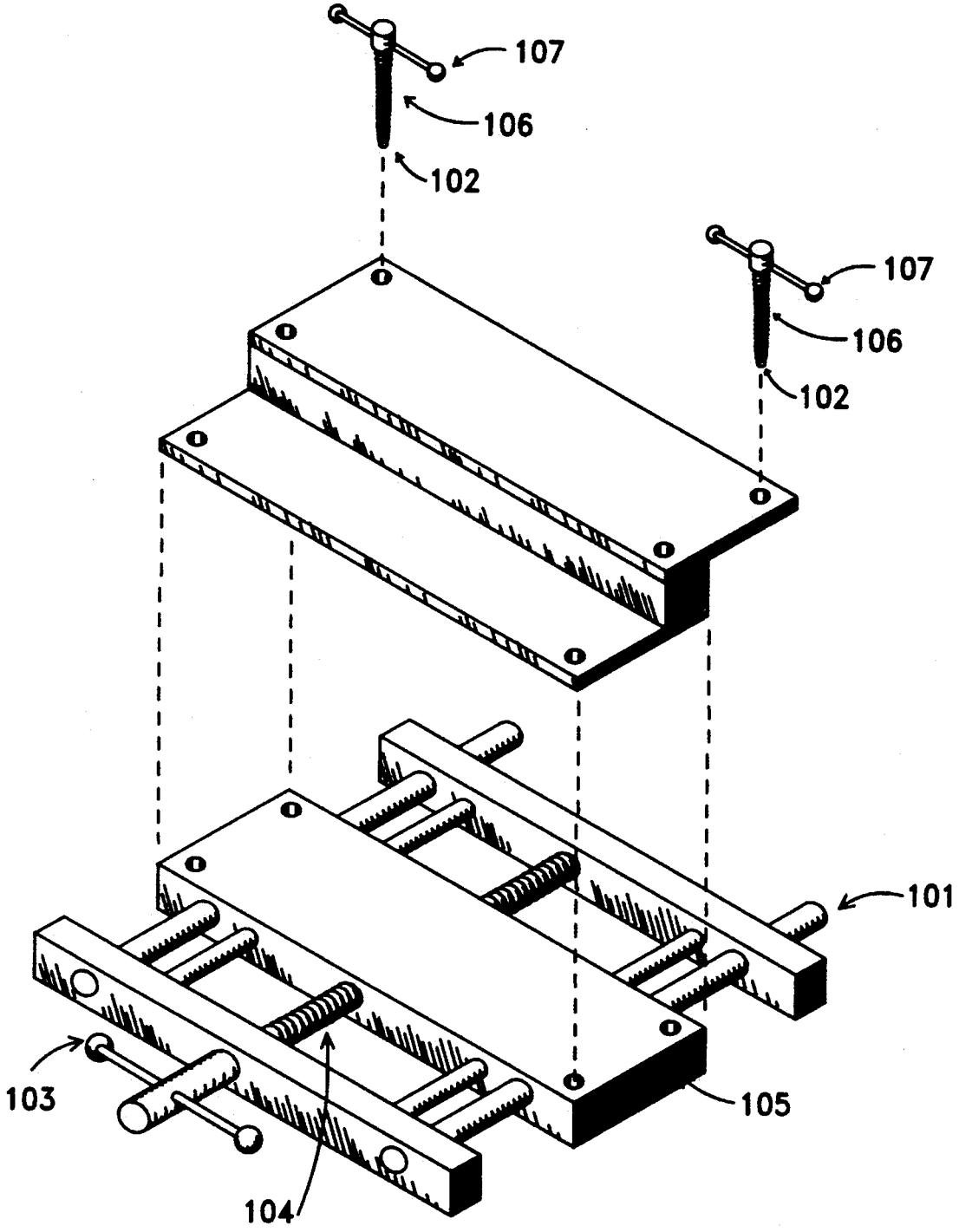
FIG. 10 is a perspective drawing of one embodiment of a stretching device for a rigid frame.

FIG. 10 is a drawing of a stretcher device suitable to use in conjunction with the current invention. The shafts, 101, are inserted into the insertion recesses, 25, of FIGS. 1 and 2. The pin, 102, of FIG. 10 is then inserted into the flange hole, 46, of FIG. 4 or, 66, of FIG. 6. By rotating the screw, 106, with the handle, 107, the border strip is moved up or down. By rotating the screw, 104, with the handle, 103, the assembly, 105, is pulled away from or toward the rigid frame, moving the border strip with it. With this device, it is possible to pull the border strips outward and downward in place against the rigid frame by merely rotating the handles in a coordinated way. Reversing the process will release the border strips.

Once a border strip has been located into place by a stretcher device, the action of the abutment flanges, 45, of FIG. 4 or cupped edge, 65, of FIG. 6 and the flange adaptors of FIG. 5 and FIG. 7 hold the border strips in place on the rigid frame. By next fastening the border strips onto the rigid frame with pins, screws, bolts, or other devices, the border strips and fabric are securely locked on the frame.

The fabric extending over the corner sections of the rigid frame can be lightly glued, taped, or fastened down in the channel, 24, of FIGS. 1 and 2 with the insertion of cords over the fabric and into the channels.

Figure 8:
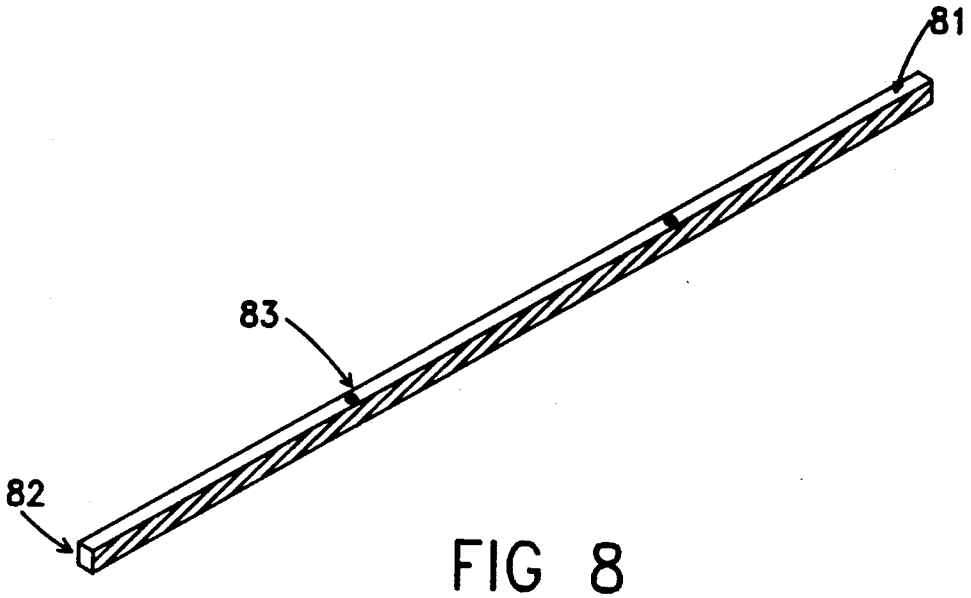
FIG. 8 is a perspective drawing of a third embodiment of the rigid/semi-rigid border strip of the present invention.
Figure 9:
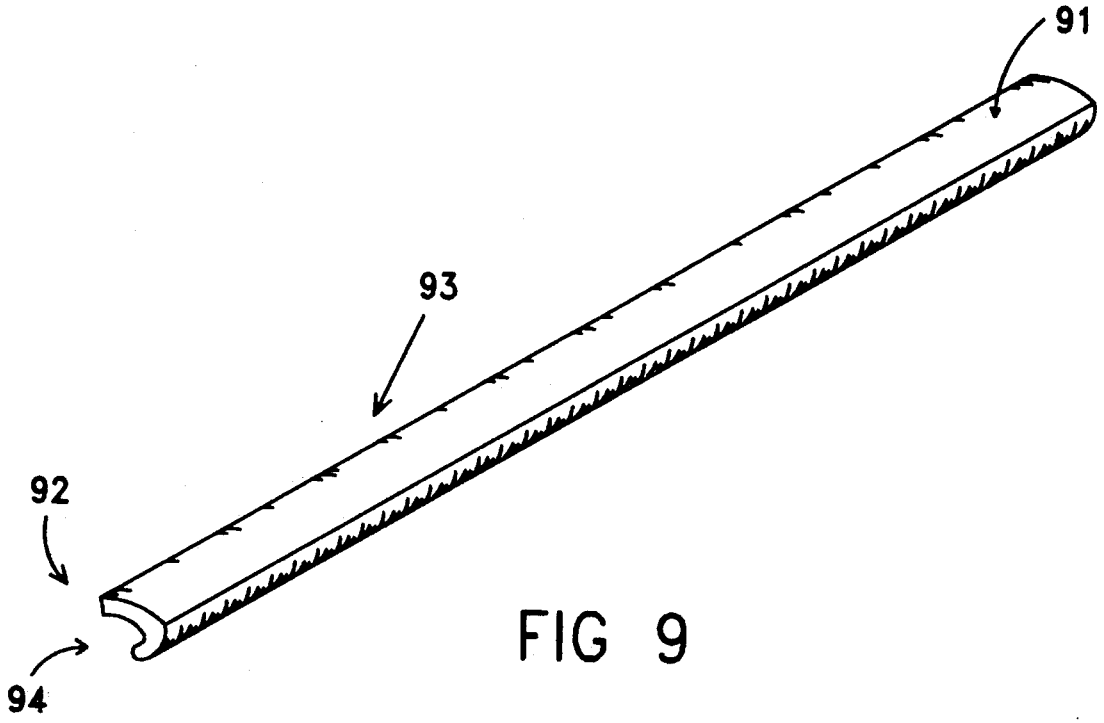
FIG. 9 is a perspective drawing of a fourth embodiment of the rigid/semi-rigid border strip of the present invention.

FIG. 8 and FIG. 9 show border strips designed for roller frames. They are identical to the border strips of FIGS. 4 and 6 except that they do not have abutment flanges or attachment flanges and they may not be as wide.

Figure 12:
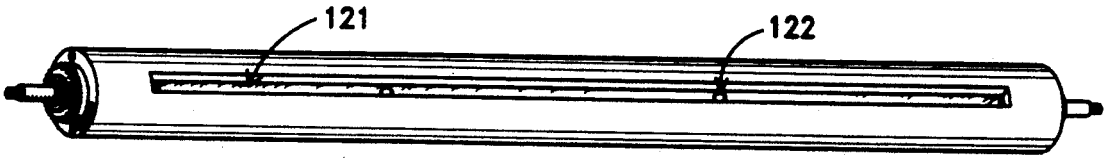
FIG. 12 is a perspective drawing of a roller channel of a roller frame of the present invention.

FIG. 12 shows a roller of a roller frame. A channel, 121, is of a prescribed length, width, depth, and location on the roller frame so as to receive the border strip of FIG. 8. Fastener features, 122, align with the fastener features, 83, of FIG. 8.

The thickness, 82, of the border strip of FIG. 8 is exactly calculated to provide for insertion into the channel, 121, of FIG. 12.

Figure 13:
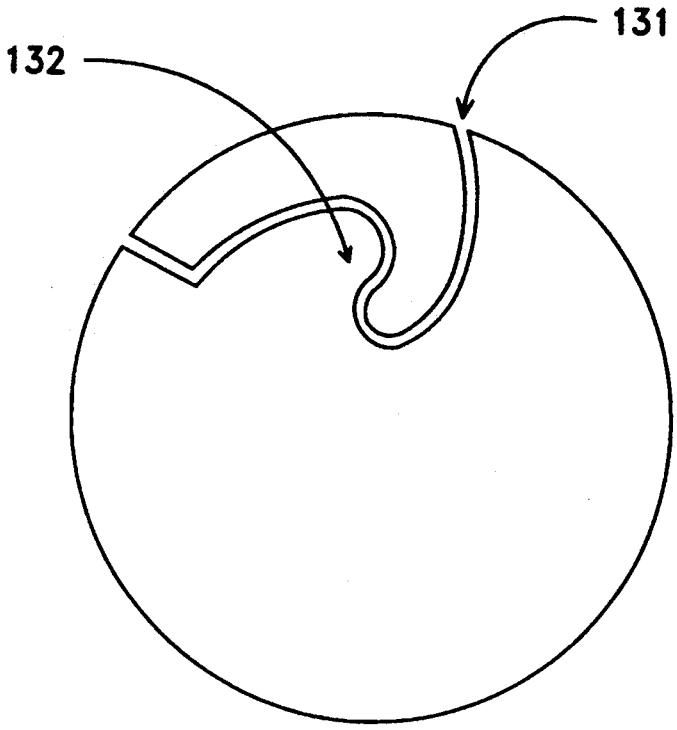
FIG. 13 is a cross sectional view of one embodiment of the roller of a roller frame of the present invention.

FIG. 13 shows a cross section of a roller with a channel, 131, that has a flange, 132, constructed into the inner wall of the channel. The thickness, 92, of the border strip of FIG. 9 is such as to provide for the insertion of said border strip into the channel, 131, of FIG. 13. The cupped edge, 94, of said border strip is such as to cup over said flange of said roller.

Figure 11:
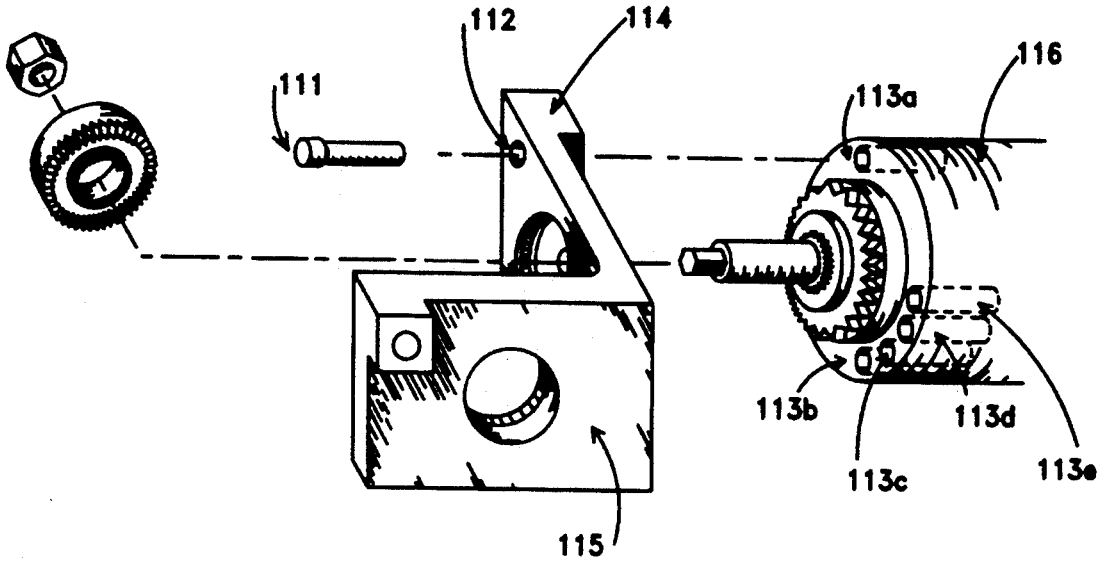
FIG. 11 is a perspective drawing of a corner member and roller end plug of a roller frame of the present invention.

FIG. 11 shows a roller frame corner member and roller end plug. The corner member, 115, has a bore, 112, with surrounding housing, 114, through which a pin, 111, can be inserted. Said pin upon being inserted through said bore is inserted into recesses, **113*a*, 113*b*, 113*c*, 113*d*, and 113*e* of the roller end plug, 116. The said end plug recesses serve as aligning features of the roller frame. Recess, 113*a*, is an alignment feature for the start position in stretching a fabric. Since the roller frame construction consists of four rollers each connected by a corner member, all four rollers can be locked down by the locking features of the roller frame into start positions as determined by the location of the recess, 113*a*, of each roller end plug. The fabric of the invention, as in the rigid frame application, is of a prescribed size and shape in relation to the roller frame. The border strips and roller channels are of a prescribed size, shape, and location relative to the coordinates of the roller frame. Recess, 113***a*, exactly controls the start position of the stretching process. By unlocking each roller and rotating it to an advanced recess of a precalculated location on the roller end plug, the stretch distance of the fabric can be controlled and predetermined just as in a rigid frame application. All of the variables of the stretch distance; the fabric size and shape, the frame size and shape, the start position, and stop positions are precalculated and prescribed. The fabric stretch distance and, hence, the fabric tension are controlled. This control is further exercised over the positioning of all coordinates of the fabric on the frame.

The foregoing description of the preferred embodiments of the invention has been presented for the purpose of illustration and description. It is not intended to be exhaustive or to limit the invention to the precise forms described. Many modifications and variations are possible in light of the above teaching. It is intended that the scope of the invention be limited not by this detailed description, but rather by the claims appended hereto.

What is claimed is:

1. A screen apparatus that comprises:

A) a frame of four corners and four sides, each side comprising fastening features in precisely measured and predetermined locations, B) a screen fabric comprising four edges;

C) a plurality of rigid border strips each having one edge adhered to a respective edge of said fabric at precisely measured locations; and D) fastening devices on said strips, said fastening devices so ordered as to fasten to said fastening features of said frame such that when said border strips are fastened to said frame in a precalculated order, said fabric is stretched on said frame in a precise manner.

2. The screen apparatus of claim 1, wherein said fastening features are arranged in first and second precisely measured and predetermined locations, said first location spaced inwardly of said second location, and wherein said fastening devices are arranged in first and second precisely measured and predetermined locations, said first location of said fastening devices spaced inwardly of said second location of said fastening devices, for stretching said fabric incrementally.

3. The screen apparatus of claim 1 wherein said frame comprises a top surface with portions of said surface between the corners of said frame comprising a lower indented plane and portions of said surface in and adjacent to said corners comprising an elevated protruding plane with the difference in the elevation of said planes corresponding to the thickness of said border strips of claim 1 and the length of said lower indented planes corresponding to the length of said border strips of claim 1.

4. The screen apparatus of claim 1 wherein the border strips comprise features with means for attaching to fastening devices of stretchers.

5. The screen apparatus of claim 1 wherein said border strips comprise features with means for abutting said border strips against said frame.

6. The frame apparatus of claim 1 wherein said border strips further comprise means for hooking said border strips onto said frame in precise and predetermined locations.

7. The screen apparatus of claim 5 further comprising spacing adapters of rigid material of predetermined length, width, and height for inserting between the outer wall of said frame and said abutting means of said border strips.

8. The screen apparatus of claim 1 wherein said frame is a roller frame, said frame comprising at least one roller and means for stopping the rotation of said roller in a plurality of precise and predetermined locations.

9. The screen apparatus of claim 8 wherein said roller comprises a channel of precalculated length, width, depth, and location, said fastening features arranged within said channel.

10. The screen apparatus of claim 9 wherein said channel comprises a flange on the inside wall of said channel, said flange for fastening said border strip.

* * * * *